US007497389B2

(12) United States Patent
Rioux

(10) Patent No.: US 7,497,389 B2
(45) Date of Patent: Mar. 3, 2009

(54) AIRLESS SPRAY PUMP SYSTEM AND METHOD FOR SPRAYING A BINDER SOLUTION WITH SUSPENDED PARTICLES

(75) Inventor: Laurier Rioux, Saint-Léon-le-Grand (CA)

(73) Assignee: Galvatech 2000, Saint-Léon-le-Grand, Québec (CA)

( * ) Notice: Subject to any disclaimer, the term of this patent is extended or adjusted under 35 U.S.C. 154(b) by 553 days.

(21) Appl. No.: 11/265,295

(22) Filed: Nov. 3, 2005

(65) Prior Publication Data

US 2007/0095938 A1 May 3, 2007

(30) Foreign Application Priority Data

Sep. 22, 2005 (CA) ..... 2520691

(51) Int. Cl.

| | |
|---|---|
| ***B05B 9/04*** | (2006.01) |
| ***B05B 9/043*** | (2006.01) |
| ***B05B 9/00*** | (2006.01) |
| ***B05B 1/30*** | (2006.01) |
| ***B05B 7/30*** | (2006.01) |
| ***A62C 11/00*** | (2006.01) |
| ***A62C 13/62*** | (2006.01) |

(52) U.S. Cl. ..... 239/332; 239/144; 239/147; 239/333; 239/340; 239/583

(58) Field of Classification Search ..... 239/146, 239/147, 302, 315, 316, 310, 329, 331, 332, 239/337, 398, 399, 402.5, 432, 144, 339, 239/340, 345, 351, 354, 378, 583; 118/50, 118/300, 308

See application file for complete search history.

(56) References Cited

U.S. PATENT DOCUMENTS

| | | | | |
|---|---|---|---|---|
| 2,895,421 | A * | 7/1959 | Peeps | 417/549 |
| 3,787,149 | A * | 1/1974 | Dane et al. | 417/554 |
| 5,304,001 | A * | 4/1994 | Kuo et al. | 366/132 |
| 5,330,783 | A * | 7/1994 | Saidman et al. | 427/8 |
| 2005/0127208 | A1 * | 6/2005 | Kaligian et al. | 239/432 |

* cited by examiner

*Primary Examiner*—Len Tran
*Assistant Examiner*—Ryan Reis
(74) *Attorney, Agent, or Firm*—Ogilvy Renault

(57) ABSTRACT

An airless spray pump system and method for spraying a binder solution having suspended particles which are non-abrasive for coating a product therewith is described. A reservoir contains a supply of the binder solution and is continuously mixed to maintain the solution in a homogeneous state. An inlet check valve is connected to the reservoir and the check valve has an outlet port which is connected to a pump. The check valve is operated by an upstroke of a piston of the pump to draw a volume of a solution through the check valve and into the pump while the pump supplies, under high pressure, a solution in a transfer chamber thereof to a pressure control unit of a spray apparatus. When the piston of the pump is in a return stroke, it forces the check valve to close under pressure and simultaneously operates a transfer check valve of the pump to open to transfer solution into the transfer chamber and forces a portion of the solution to the pressure control unit. When the solution is displaced through the inlet check valve and the transfer check valve of the pump, it causes a washing action of the parts in contact with the solution to prevent particles in the solution from sticking or settling down on these parts.

21 Claims, 9 Drawing Sheets

AIRLESS SPRAY PUMP SYSTEM AND METHOD FOR SPRAYING A BINDER SOLUTION WITH SUSPENDED PARTICLES

TECHNICAL FIELD

The present invention relates to an airless spray pump system and method for spraying a binder solution having suspended particles, which are non-abrasive, for coating a product therewith.

BACKGROUND ART

There are several airless paint and coating solution sprayers on the market and these work very well and are reliable with several types of coatings such as water-base coatings or organic base coatings, epoxides, etc. However, these known spraying apparatus are not reliable and are in fact troublesome and require frequent maintenance when the solution is a binder solution having suspended particles which are non-abrasive, such as zinc particles in a cold galvanizing solution for coating steel products which are prone to the formation of oxidation (rust). Usually, when known prior art pumps are used to spray such solution, they fail within one hour of usage due to the particles in the solution. These pumps are piston pumps and their packing quickly deteriorates. Also, they use ball-type check valves and the particles accumulate under the action of pressure in the area of these check valves and they become inoperative requiring replacement parts and/or cleaning.

Another disadvantage of known prior art spraying apparatus is that when they use binder solution with suspended particles, the suspended particles have a tendency of settling into the solution when maintained stagnant for short periods of time and heavier particles settle to the bottom of the buckets containing such solution. Accordingly, the solution sprayed is not a homogeneous solution and this is also problematic.

SUMMARY OF INVENTION

It is a feature of the present invention to provide an airless spray pump system which substantially overcomes the above-mentioned disadvantages of the prior art.

Another feature of the present invention is to provide a method of spraying a binder solution having suspended particles which are non-abrasive for coating a product therewith by spraying the product with the solution under pressure and wherein the solution is maintained homogeneous.

Another feature of the present invention is to provide an airless spray pump system using an inlet check valve and a piston pump and wherein no ball valves are utilized therein and wherein the parts of the check valve and piston which are in contact with the binder solution are self-cleaned by a washing action created by the solution itself when displaced therein.

Another feature of the present invention is to provide an airless spray pump system and method which is reliable and which does not require the extensive maintenance of known prior art systems and methods.

Another feature of the present invention is to provide an airless spray pump system wherein the binder solution is continuously maintained in a homogeneous state in a reservoir.

According to the above features, from a broad aspect, the present invention comprises an airless spray pump system for spraying a binder solution having suspended particles which are non-abrasive for coating a product therewith. The system has a reservoir for containing a supply of the binder solution. The reservoir is provided with mixing means for maintaining the solution in a homogeneous state. An inlet check valve is connected to the reservoir. A pump is connected to an outlet port of the inlet check valve for operating the inlet check valve to an open position during an upstroke of a piston of the pump to draw a volume of the solution through the inlet check valve and into a chamber of the pump. The pump also simultaneously forces, under high pressure, solution contained in a transfer chamber of the pump, out of the pump to a pressure control unit of a spray apparatus. The piston when displaced on a return stroke applies pressure against the solution in the chamber and forces the inlet check valve to close under the said pressure preventing the solution to flow back to the reservoir and simultaneously operates a transfer check valve of the pump to open to transfer solution from the chamber to the transfer chamber and forces a portion of the solution under high pressure to the pressure control unit. The solution when displaced through the inlet check valve and the transfer check valve causes a washing action of parts in contact with the solution to thereby prevent particles in the solution from sticking or settling down on the parts in the inlet check valve and the pump.

According to a further broad aspect of the present invention there is provided a method of spraying a binder solution having suspended particles which are non-abrasive for coating a product therewith by spraying the product with the solution under pressure. The method comprises continuously mixing the solution in a reservoir to maintain the solution homogeneous. A predetermined quantity of the solution is drawn from the reservoir through an inlet check valve to fill a chamber of a pump. The method also comprises pumping the predetermined quantity of the solution under pressure to a pressure control unit of a spraying apparatus through a reciprocating piston of the pump. The step of pumping includes displacing the piston on an upstroke to open the check valve to draw the predetermined quantity of solution therethrough by suction to fill the chamber of the pump and simultaneously force under pressure solution in a transfer chamber of the pump to the pressure control unit. On the return stroke of the piston pressure is applied against the solution in the chamber and thereby forces the check valve to close and simultaneously a transfer check valve of the pump is opened to transfer solution from the chamber to the transfer chamber and forcing a portion of the solution from the transfer chamber to the pressure control unit. The method also causes a washing action of the parts of the check valve and the pump which are in contact with the solution by the displacement of the solution under pressure to prevent particles in the solution from striking or settling down in the inlet check valve and the pump.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
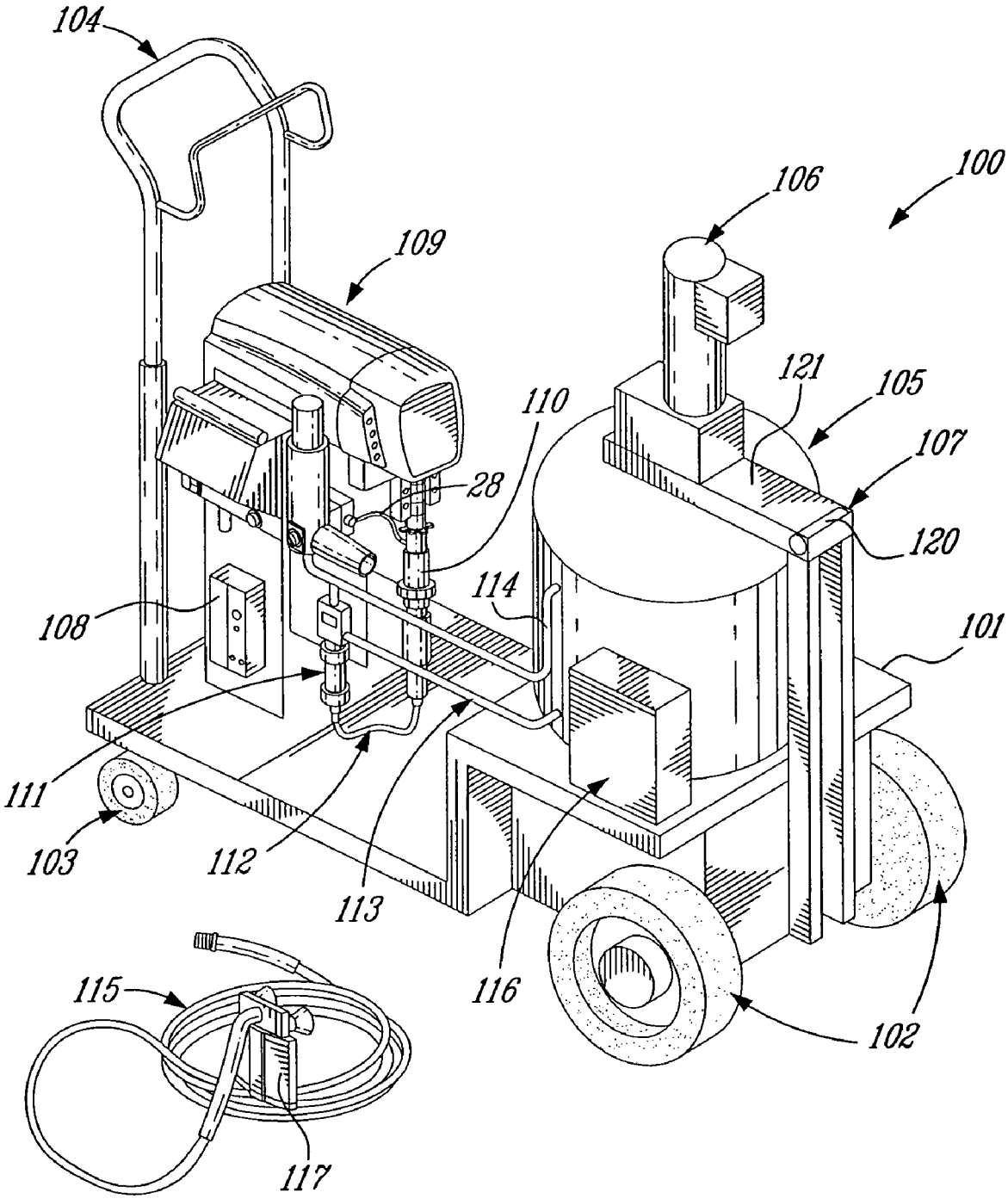
FIG. 1 is a perspective view of the airless spray pump system of the present invention mounted on a displaceable frame supported on wheels.

Referring to the drawings and more particularly to FIG. 1, there is shown generally at 100 the airless spray pump system of the present invention which is mounted on a displaceable frame 101. The frame is supported for displacement by rigid wheels 102 at one end of the frame and caster wheels 103 at the other end thereof. A handle 104 is secured to the frame for displacing the frame on a surface. A stirring reservoir 105 is supported on the frame for containing a binder solution therein. An electric motor with reduction gear head 106 constitutes the drive for stirring blades supported inside the reservoir as will be described later. A tower 107 has a support arm section 121 secured thereto by a hinge 120 and positions the arm section 121 in a position of use, as hereinshown, or a disconnected position where the arm is tilted upward to disconnect the drive from the drive shaft of the stirring blades as will also be described later. A variable speed controller 108 controls the speed of the motor 106 and accordingly the stirring speed of the blades inside the reservoir.

The airless spray pump system also comprises a sprayer device 109 having a pump 110 which is connected to an inlet check valve 111 through a union pipe 112. An inlet port of the inlet check valve 111 is also connected to the reservoir through a suction hose 113. A high pressure hose 28 is secured to the pump 110 and to a pressure control unit 27 (see FIG. 2) to which is connected the high pressure hose 115 of a spraying apparatus, herein a spray gun 117. A spray gun solvent dipping container 16 is also provided. A spray bypass hose 114 also connects to the sprayer device 109 and the top of the reservoir 105.

Figure 2:
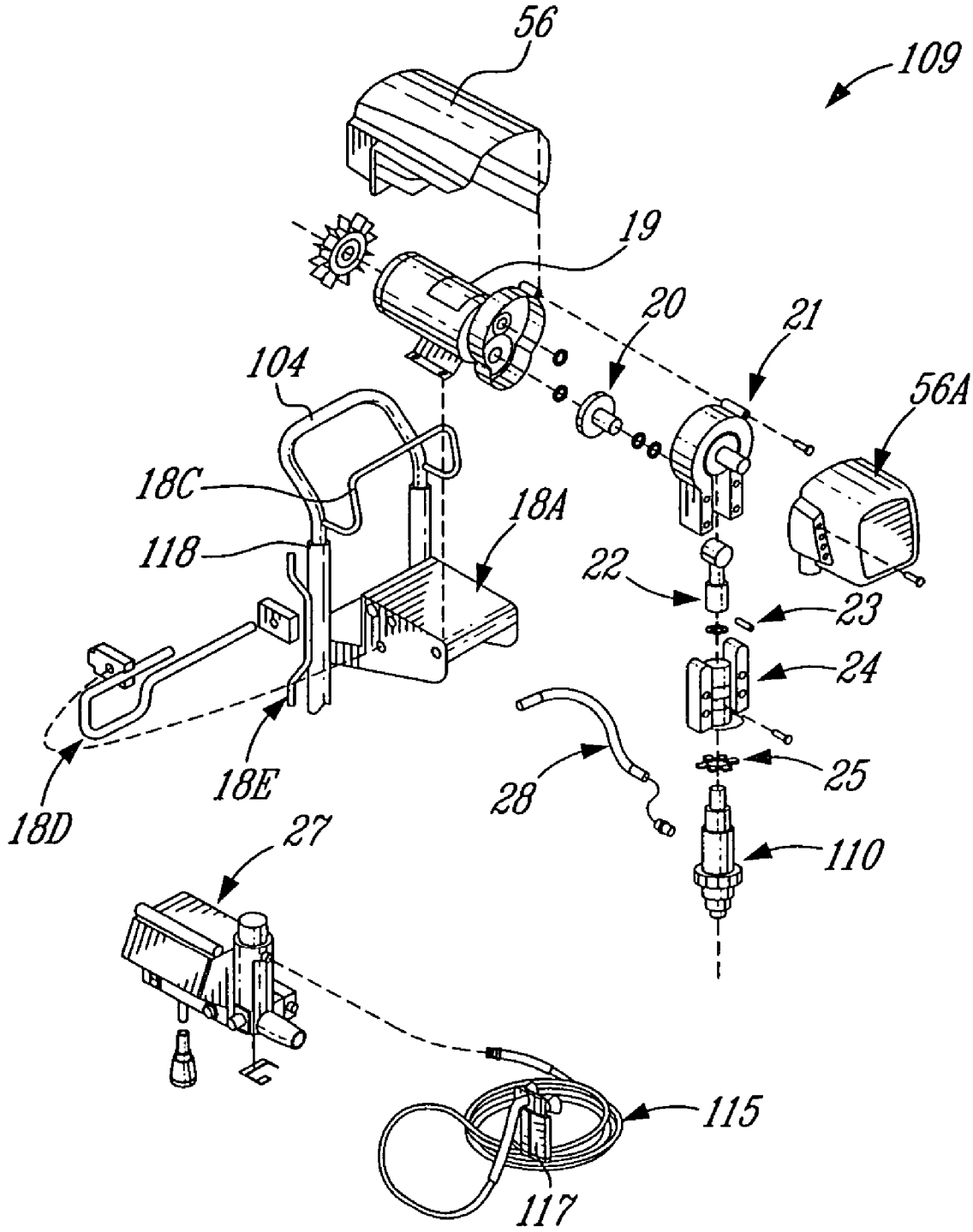
FIG. 2 is an exploded view showing the construction of the pump and the pressure control unit and spray apparatus.
Figure 3A:
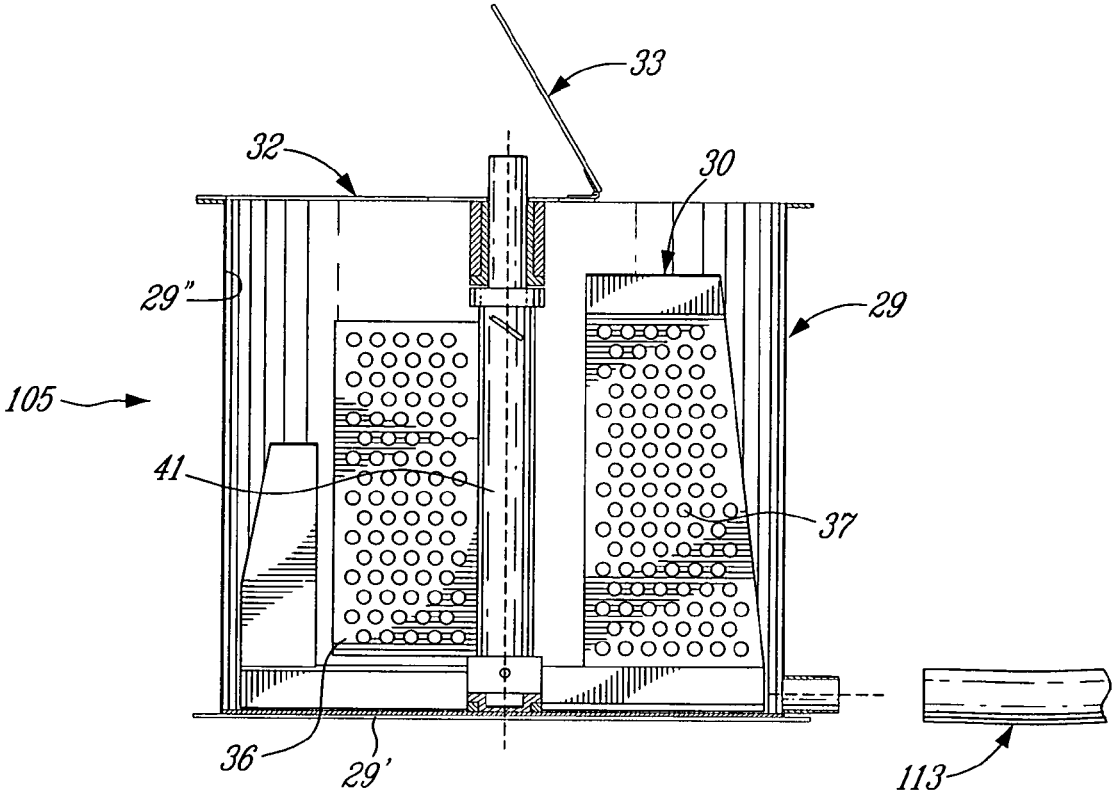
FIGS. 3A and 3B are side section views showing the construction of the reservoir with its mixing blades.
Figure 3B:
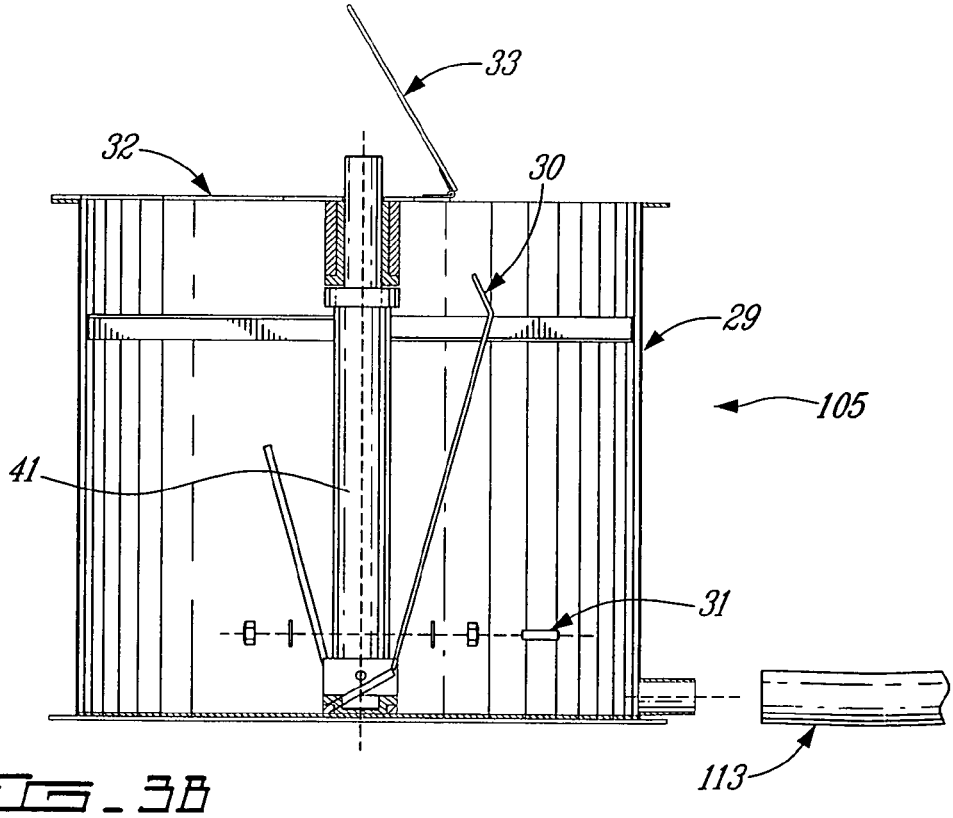
Figure 4A:
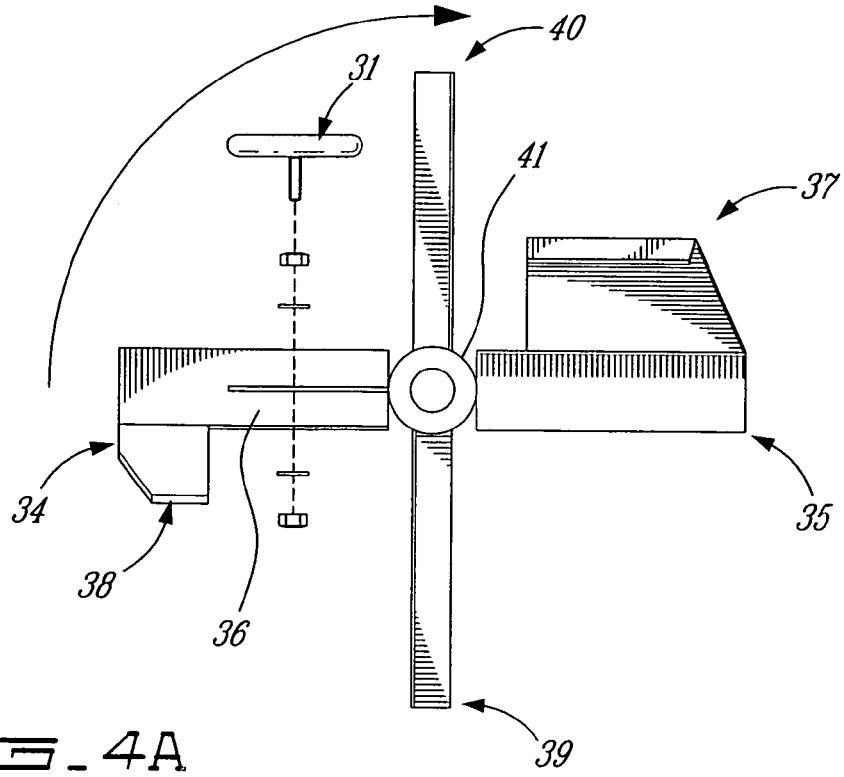
FIGS. 4A and 4B are top views showing the construction of the mixing blades.
Figure 4B:
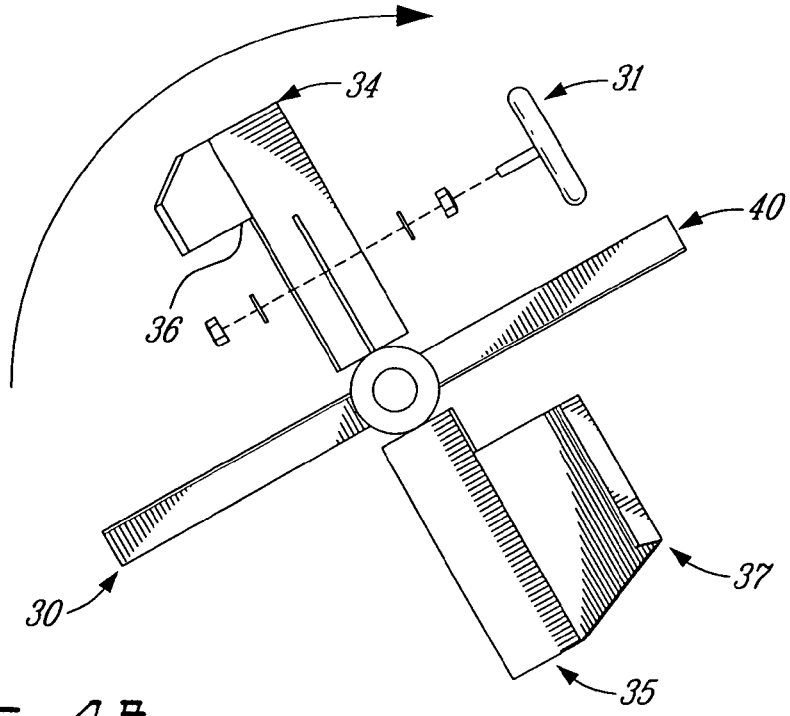
Figure 4C:
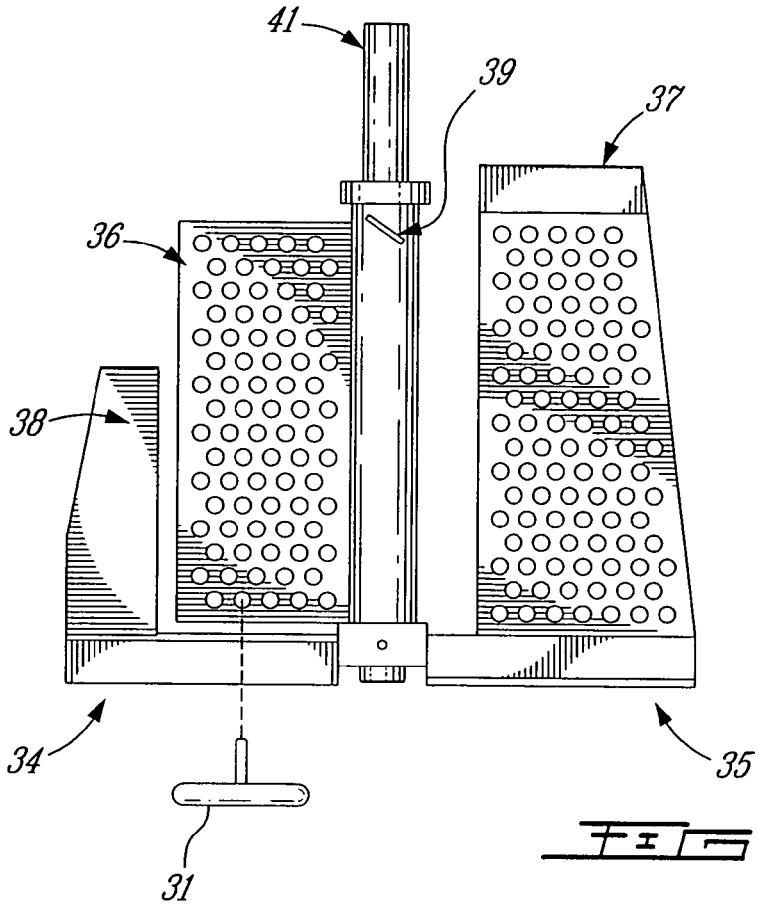
FIGS. 4C and 4D are side views further showing the construction of the mixing blades.
Figure 4D:
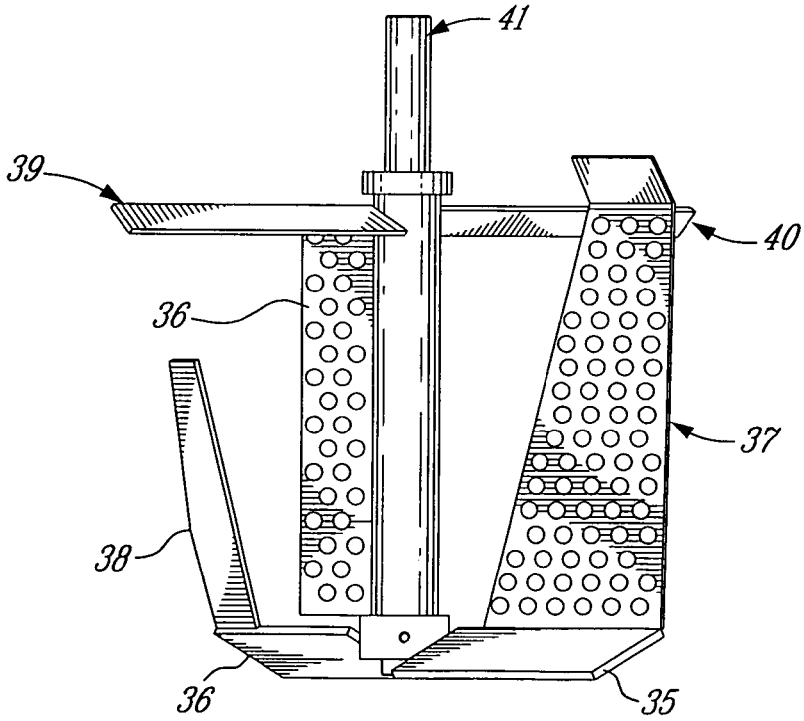

Referring now to FIG. 2, there is shown an exploded view of the component parts of the sprayer device 109 and it is one selected from the existing market but with the pump 110 being modified in accordance with the present invention. As hereinshown the sprayer device 109 is mounted on a mounting base 18A secured to the sub-frame 118 to which the handle 104 is secured. Gun hose wraps 18C and 18D are mounted to the frame and handle. An electrical power chord wrap 18E is also secured to the frame. An electric motor 19 drives a reciprocating unit 21 through a gear train 20. A connecting rod 22 is connected to the connecting end 142 of the piston rod 57 by a piston rod pin 23. Displacement unit braket 24 is secured to reciprocating unit 21 with screws. The top of the piston pump 110 is screwed into the bottom of displacement unit bracket 24 and secured with lock nut 25. The sprayer device 109 further includes a self-recycling pressure control unit 27, well known in the art, to which is connected the high pressure hose 115 of the spraying apparatus 117. Hoods 56 and 56A cover the electric motor 19 and the reciprocating unit assembly 21. This spraying device is essentially a motorized pressure control reciprocating device which imparts a vertical continuous motion to the piston rod of the pump 110 as will be described later.

Referring now to FIGS. 3A to 4D, there is shown the construction of the stirring reservoir 105. As hereinshown the reservoir 105 is a cylindrical container 29 having a mixing shaft 41 supported centrally and co-axially with the cylindrical container. The container is provided with a cover 32 having a filler trap door 33 to receive solution therein. The suction hose 113 is secured adjacent the bottom wall 29' of the container 29. An impeller assembly 30 is secured to the driven shaft 41 and is comprised of a plurality of mixing or stirring blades 34 to 40 as is better illustrated in the top views of FIGS. 4A and 4B. Blades 34 to 40 are oriented and shaped to mix the product such that it remains homogeneous and does not stick to the inner wall 29" of the reservoir or its bottom wall 29'. This stirring reservoir makes it possible for a user to pour pre-stirred solution into the reservoir and obtain proper stirring prior to delivering the solution to the inlet check valve 111 through the suction hose 113. When the product is ready for spraying, the user will set the stirring speed of the blades by the use of the variable speed control 108 and will maintain an optimal continuous speed during the spraying process. During periods of rest, the speed can be set to different speeds to maintain the solution homogeneous. The reservoir is also provided with a steel abrasive contaminant catcher 31 and the blades are perforated, as herein illustrated. The blades are formed from flat metal sheeting to provide rigidity to adequately mix the solution to maintain it in this substantially homogeneous state and also substantially free of trapped air. As also better illustrated in FIGS. 3A and 3B, the top end of the driven shaft 41 extends above the cover 32 for removable connection with a socket (not shown) at the end of a drive shaft (also not shown) of the drive motor 106.

Figure 5A:
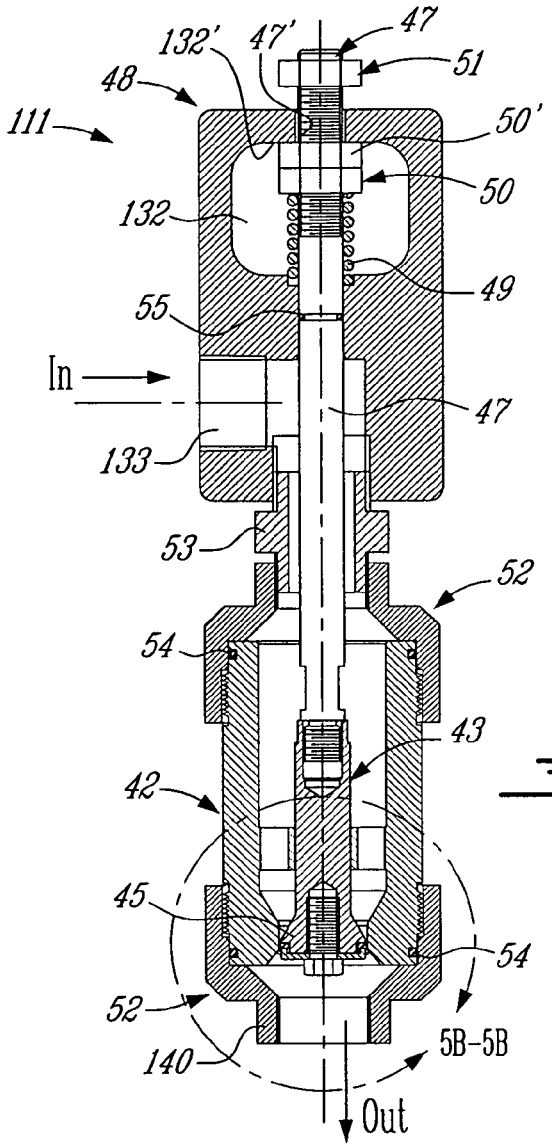
FIG. 5A is a side section view showing the construction of the inlet check valve.
Figure 5B:
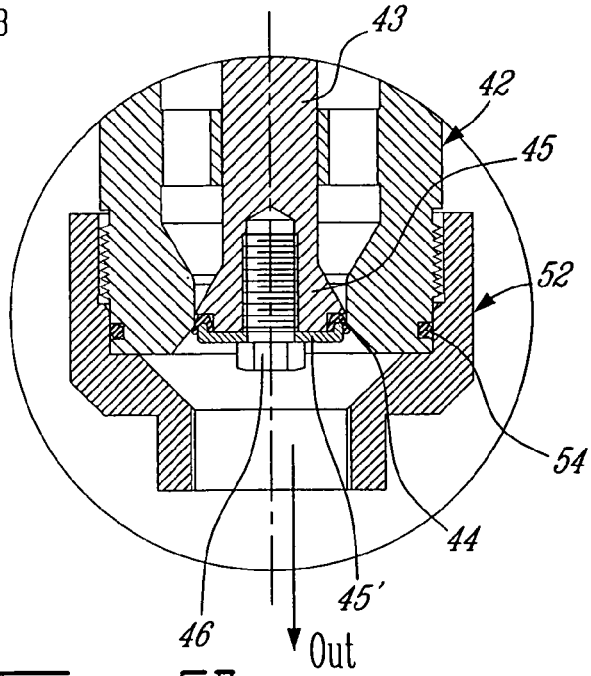
FIG. 5B is an enlarged section view showing the poppet head in a closed sealed position with the valve seat of the inlet check valve.
Figure 6A:
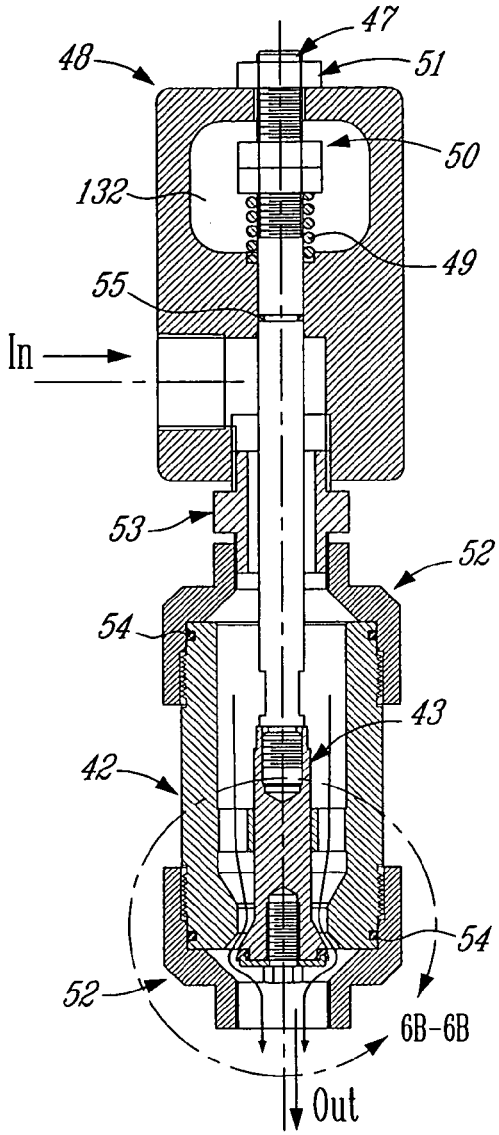
FIG. 6A is a side section view similar to FIG. 5A but showing the check valve in an opened condition.
Figure 6B:
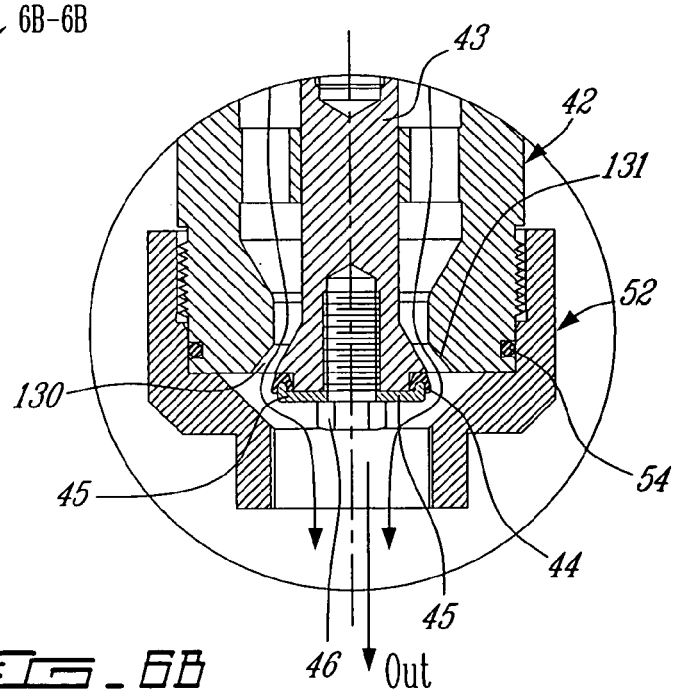
FIG. 6B is an enlarged section view similar to FIG. 5B but showing the poppet head at an open position creating a passage between the poppet head and the valve seat.

Referring now to FIGS. 5A to 6B, there will be described the construction and operation of the inlet check valve 111. This valve is essentially an elastomeric poppet type check valve designed to prevent metallic particles from the solution to accumulate and/or to stick to any internal walls or parts of the valve. The valve consists essentially of a valve seat body section 42 which houses the poppet 43 which is provided with an elastomeric seal 44 as better shown in FIG. 5B. A poppet seal holder 45' secures the seal to the bottom end of the poppet head 45 defined at the bottom of the poppet 43 and retained thereto by the screw 46. The poppet 43 is secured to a poppet stem 47 which extends through a valve head section 48. The poppet stem 47 has an upper and lower position stopper connected thereto and constituted by adjustable nuts 50 and 51, respectively, whereby to adjust the travel distance of poppet 43 and consequently the size of the flow path opening 130, as shown in FIG. 6B when the check valve is in an open condition. This opening is defined between the poppet head 45 and the valve seat 131 as shown in FIG. 6B.

The valve head section 48 is provided with a hollow accessible chamber 132 located exteriorly of a flow path of the solution. A helical spring 49 is retained about the poppet stem in the hollow chamber 132 and has a spring force which is selected to bias the poppet head 45 against the valve seat 131 during rest conditions. The closed position of the valve head is illustrated in FIG. 5A and as hereinshown the nut 50' is in contact with the top wall 132' of the chamber 132 limiting the upward displacement of the stem 47. Limiting the travel of the poppet stem is achieved by the nuts 50. The position of the nuts 50 limits the poppet head to travel to no further up than the check valve seat edge 131 and stay stationary in there. The nut 51 limits the poppet head in its downward displacement not to clogg the flow path or be drawn in the outlet fitting. The check valve is also provided with an inlet port 133 which connects to the suction hose 113 and to the reservoir 105, as previously described with reference to FIG. 1.

Figure 7:
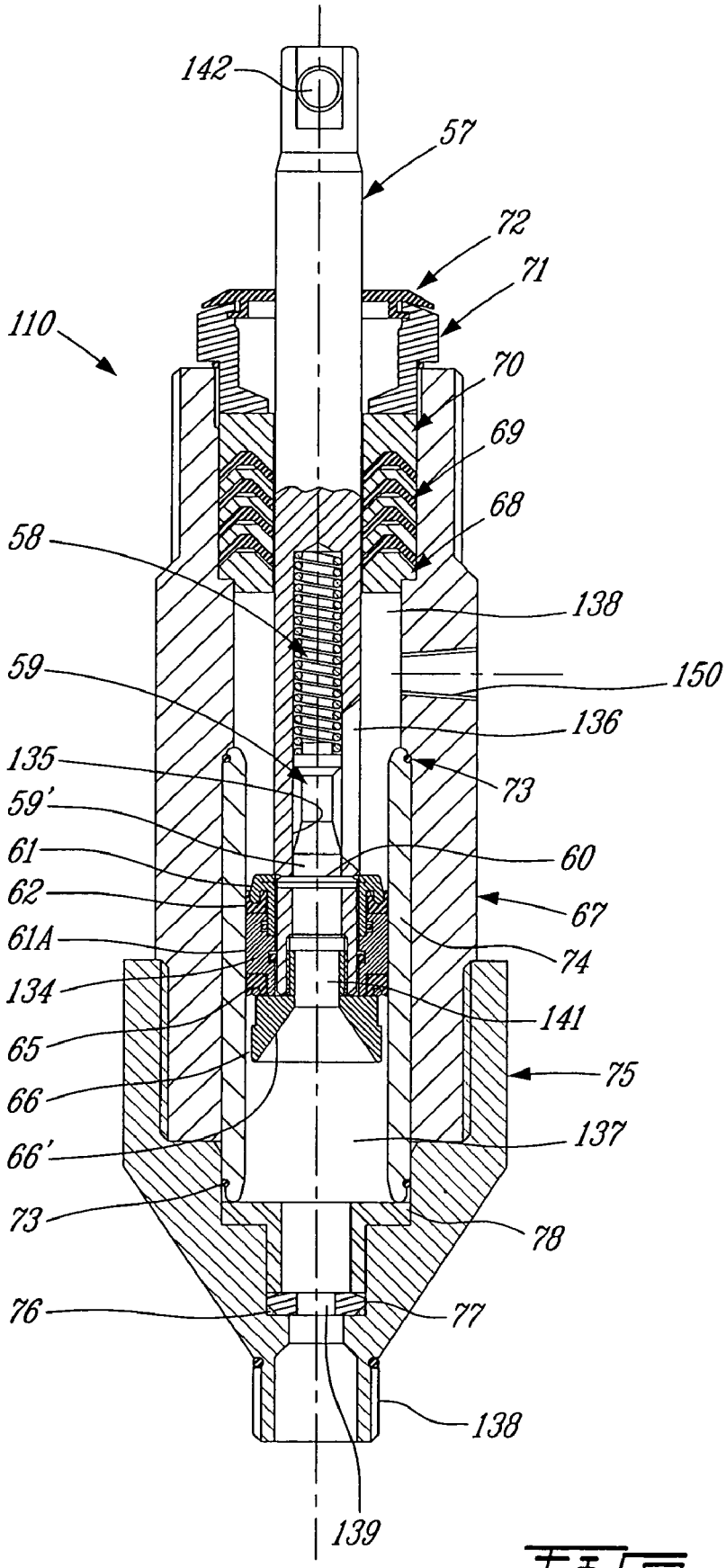
FIG. 7 is a side section view showing the construction of the pump with the transfer check valve in a closed position.
Figure 8:
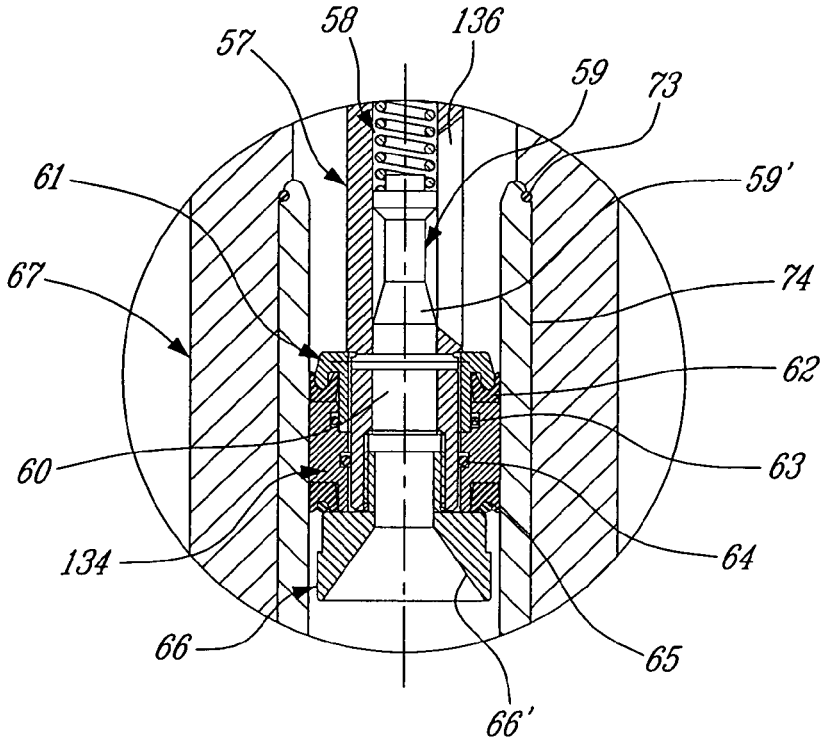
FIG. 8 is an enlarged section view showing the construction of the hollow piston head of the pump with the transfer check valve thereof in a closed position.
Figure 9:
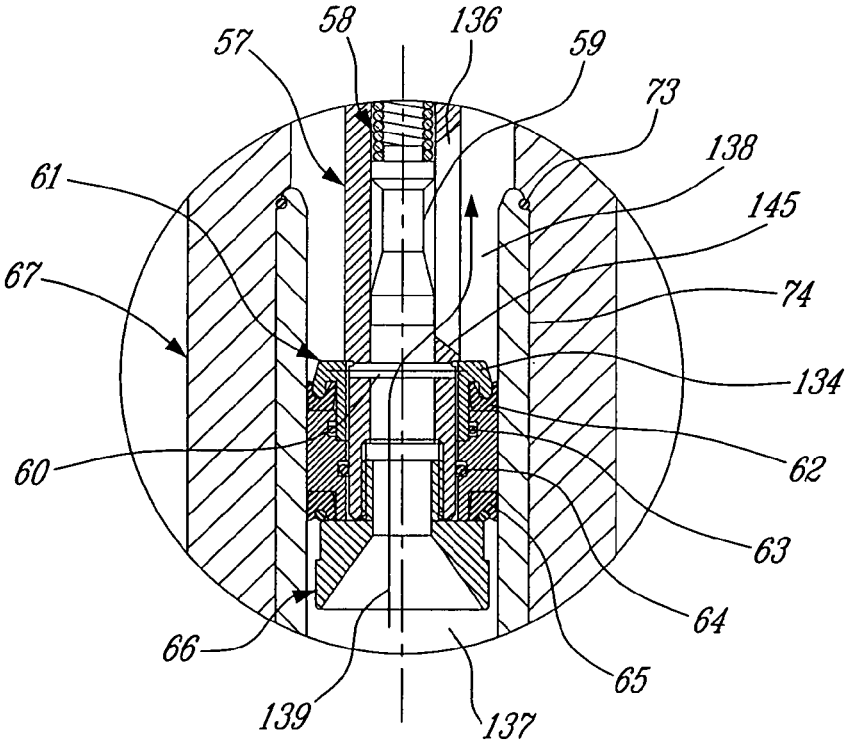
FIG. 9 is a view similar to FIG. 8 but showing the transfer check valve in an open position.

With reference now to FIGS. 7, 8 and 9, there will be described the construction and operation of the pump 110. The pump is essentially a displacement unit for the solution whereby to feed the solution under pressure to the pressure control unit 27 while at the same time drawing solution from the reservoir through the check valve. The pump consists of a piston rod 57 connected to the reciprocating unit 21, illustrated in FIG. 2, whereby to displace the piston rod up and down in the piston cylinder 74. Accordingly, the piston rod is displaced to effect an upstroke and a return downstroke. The piston rod has a hollow piston head 134 which is sealingly displaceable in a cylinder 74. An axial bore 135 is provided in the piston rod and communicates with the hollow piston head 134. A transfer check valve 59 is located within the axial bore 135 and retained captive therein adjacent a transfer opening 136 formed in the piston rod. The transfer check valve is slidingly displaceable in the axial bore. The transfer check valve 59 is also spring-biased with its cylindrical head 59' against an arresting element, herein a retaining pin 60 spaced below the transfer opening 136 by the force of a helical return spring 58 when the pump is at rest. During the upstroke of the piston the calibrated valve return spring 58 maintains the transfer check valve 59 in a position sealing the transfer opening 136 from the chamber 137 below the piston head 134 as illustrated in FIG. 8. When the piston is displaced in its return downstroke, as illustrated in FIG. 9, the piston pressure exerted on a solution contained within the chamber 137 forces the transfer check valve 59 to open by overcoming the biasing pressure of spring 58, by about 200 lbs., and creating an opening 145 between the chamber 137 and the transfer opening 136 permitting solution from the chamber 137 to flow under high pressure into a transfer chamber 138 as illustrated by arrow 139 in FIG. 9.

The pump 110 is further provided with a piston upper sleeve 61, a piston bottom sleeve 61A, upper piston seal 62 and internal piston seals 63 and 64. A bottom piston seal 65 and a hollow piston screw or head 66 are also provided. Piston rod packings 68 to 70 are secured in the upper part of a cylinder about the piston rod. A holder 71 holds the packing and a dust seal 72 is secured on top of the packing holder. Cylinder sleeve seals 73 are also provided. A bottom cap 75 and bottom washer seal 76 are secured to the bottom of the cylinder. It is also provided with a bottom washer and bottom sleeve 78. As can be seen, there are no ball check valves in this pump nor in the inlet check valve 111.

The hollow piston screw 66 of the piston head 134 has a lower conical shape entrance 66' which flares outwardly into the chamber 137 located thereunder. A restricted passage 139 is defined at the bottom end of the cylinder 67 and a connector end 138 provides connection to the union pipe 112, as shown in FIG. 1. The piston head has an internal passage 141 with the retaining pin 60 secured thereacross. As hereinshown the transfer check valve 59 is a spool type valve having a cylindrical valve head 59' disposed for close sliding friction fit in the axial bore 135. The valve head is dimensioned to seal the chamber 137 from the transfer chamber 138 when bottoming against the retaining pin 60.

Having thus generally described the construction of the inlet check valve 111 and the pump 110, we will now describe the interaction thereof and the operation of the airless spray pump system of the present invention. Reference is therefore made to FIGS. 1 and 5A to 9. As previously described, the connecting end 142 of the piston rod 57 is connected to the reciprocating unit 21 which causes the piston rod 57 to move up and down in the piston cylinder 74. During the upstroke of the piston rod 57, the piston head 134 is drawn upwardly and this causes a suction in the union pipe 112 due to the expansion of the chamber 137 below the piston head and which chamber is filled with solution. This suction is transferred to the poppet head 45 of the check valve and draws the check valve open by exceeding the spring force of the helical spring 49 which is normally biasing the poppet head against its valve seat. This suction pressure which overcomes the force of this spring also causes a suction through the inlet check valve drawing solution from the reservoir into the check valve via the suction hose 113 connected to the inlet port 133 of the check valve and fills the expanding chamber 137. This upstroke of the piston head also applies pressure against solution which is held captive in the transfer chamber 138 about the piston rod and forcing a predetermined quantity of that solution, depending on the length of the displacement of the piston head into the pressure control unit 27 of the spray apparatus through the outlet port 150 to which is connected the hose 28.

When the piston rod 57 is displaced in a return downstroke, the piston head 134 applies pressure against the solution in the chamber 137 and forces the inlet check valve poppet head 45 to close under this pressure preventing the solution from the chamber 137 and the union pipe 112 from flowing back into the reservoir 105 through the check valve. Simultaneously, due to the pressure exerted by the piston the transfer check valve 59 is forced to move upwardly against its spring bias causing the transfer check valve to assume its open position as shown in FIG. 9. This pressure by the displacement of the piston head 134 forces solution through the opening 145 from the chamber 137 to the transfer opening 136 and into the transfer chamber 138 and then into the pressure control unit via the hose 28. This solution is transferred under the high pressure of the pump. Accordingly, fluid is displaced through the inlet check valve by suction caused by the piston and through the transfer check valve 59 by the upstroke displacement of the piston. This displacement of the solution through the check valve and the pump causes a washing action of the parts which are in contact with the solution thereby preventing particles in the solution from sticking or settling down on the parts of the inlet check valve and the pump.

In a preferred embodiment this binder solution is a cold galvanizing solution which contains powdered zinc particles. The pump also operates at a pressure in the range of about 1500 lbs/sq.in.

Summarizing the method of operation of the airless spray pump system, the method comprises continuously mixing the binder solution in the reservoir 105 to maintain the solution homogeneous. A predetermined quantity of the solution is drawn from the reservoir through the inlet check valve 111 to fill the chamber 137 and associated conduits. A predetermined quantity of the solution is pumped under pressure to the pressure control unit 27 of the spraying apparatus through the pump which is provided with a reciprocating piston to do so. The steps of pumping include displacing the piston on an upstroke to open the check valve 111 to draw a predetermined quantity of solution therethrough by suction whereby to fill the chamber 137 or parts thereof and simultaneously force under pressure solution in the transfer chamber 138 of the pump to the pressure control unit 27.

The method further comprises displacing the piston on a return stroke to apply pressure against the solution in the chamber 137 and thereby force the check valve to close and simultaneously operate the transfer check valve 59 of the pump to open to transfer solution from the chamber 137 to the transfer chamber 138 and forcing a portion of the solution to the pressure control unit 27. As previously described, this creates a washing action of the parts of the inlet check valve and the pump which are in contact with the solution by the displacement of the solution under pressure or under suction to prevent particles in the solution from sticking or settling down on the parts or elements in contact therewith. The user of the system also can adjust the mixing speed of the solution in the reservoir by using a variable speed controller whereby the solution is always maintained homogeneous. The pressure adjustable control unit 27 also automatically regulates the pressure of the solution which is fed to the spray gun 117.

It is within the ambit of the present invention to cover any obvious modifications of the preferred embodiment described herein provided such modifications fall within the scope of the appended claims.

The invention claimed is:

1. An airless spray pump system for spraying a binder solution having suspended particles which are non-abrasive for coating a product therewith, said system comprising a reservoir for containment of a supply of said binder solution, mixing means in said reservoir for maintaining said solution in a homogeneous state, an inlet check valve connected to said reservoir; a pump connected to an outlet port of said inlet check valve for operating said inlet check valve to an open position during an upstroke of a piston of said pump to draw a volume of said solution through said inlet check valve and into a chamber of said pump and simultaneously forcing, under high pressure, solution contained in a transfer chamber of said pump out of said pump to a pressure control unit of a spray apparatus; said inlet check valve having an inlet port thereof connected to said reservoir by a suction hose, suction in said hose being generated by the upstroke of said piston in said pump, and an outlet port connected to said chamber of said pump through a union pipe, and a poppet head secured to a poppet stem axially displaceable in said inlet check valve with said poppet head spring-biased against a valve seat adjacent said outlet port, said piston when displaced on a return stroke applying pressure against said solution in said chamber and forcing said inlet check valve to close under said pressure preventing said solution to flow back to said reservoir and simultaneously operating a transfer check valve of said pump to open to transfer solution from said chamber to said transfer chamber and forcing a portion of said solution under high pressure to said pressure control unit, said solution when displaced through said inlet check valve and said transfer check valve causing a washing action of parts in contact with said solution to thereby prevent particles in said solution from sticking or settling down on said parts in said inlet check valve and said pump.

2. A system as claimed in claim 1 wherein said binder solution is a cold galvanizing airless solution containing powdered zinc.

3. A system as claimed in claim 1 wherein said high pressure is in the range of about 1500 lbs/sq.in.

4. A system as claimed in claim 1 wherein said poppet has an elastomeric seal secured thereto for frictional sealing engagement with said valve seat.

5. A system as claimed in claim 1 wherein said poppet stem has an upper and lower position stopper connected thereto, and a helical spring about said poppet stem and having a spring force to bias said poppet head against said valve seat, said upstroke of said piston of said pump exerting a suction force against said poppet head and overcoming said spring force to cause said poppet head to move away from said valve seat to create a flow path between said poppet head and said valve seat to cause the flow of solution from said inlet port towards said outlet port and about said poppet head.

6. A system as claimed in claim 5 wherein said stopper is an adjustable stopper whereby to adjust the size of said flow path opening defined between said poppet head and said valve seat.

7. A system as claimed in claim 6 wherein said check valve has a valve head section provided with a hollow accessible chamber located exteriorly of a flow path of said solution and through which said poppet stem extends, said helical spring being retained captive in said chamber about said stem and being compressed, said poppet stem having a threaded free end portion, said chamber having an upper wall, a first threaded nut about said stem and disposed in said chamber to adjust an upward displacement of said poppet stem, a second threaded nut about said stem above said chamber of abutment with a top surface of said upper wall to adjust a downward displacement of said poppet stem.

8. A system as claimed in claim 1, wherein said piston of said pump has a piston rod connected to a reciprocating unit to cause axial displacement of said piston rod to effect said upstroke and return stroke thereof, said piston rod having a hollow piston head sealingly displaceable in a cylinder, an axial bore in said piston rod communicating with said hollow piston head, aid transfer check valve being retained active in said axial bore adjacent a transfer opening formed in said piston rod and slidingly displaceable therein, said transfer check valve being spring biased against an arresting element spaced below said transfer opening when said piston is moving upwards during said upstroke and sealing said transfer opening from said chamber.

9. A system as claimed in claim 8 wherein said piston head is displaceable in a piston cylinder sleeve, and sealing means associated with said hollow piston head and cylinder sleeve, said hollow piston head having a lower conical shaped entrance flaring outwardly into said chamber located thereunder, and a restricted passage at a bottom end of a cylinder of said pump for connection to said union pipe.

10. A system as claimed in claim 9, wherein said transfer check valve is a spool type valve having a cylindrical valve head disposed in close sliding friction fit in said axial bore, a valve return spring held captive in said axial bore between a bottom end thereof and said spool type valve for biasing said valve head against said arresting element, said valve return spring being a calibrated return spring which is caused to compress by the pressure of said solution in said chamber when said piston is displaced in said return stroke.

11. A system as claimed in claim 10 wherein said arresting element is a retaining pin secured across an internal passage of said hollow piston head.

12. A system as claimed in claim 1 wherein said mixing means is constituted by a stirring impeller having a driven shaft retained in said reservoir, a variable speed drive and a speed control to adjust the speed of rotation of said driven shaft, stirring blades secured to said driven shaft, and an abrasive contaminant catcher rotatably displaced with said driven shaft.

13. A system as claimed in claim 12 wherein said reservoir is a cylindrical reservoir having a top cover with a filler trap door to receive said solution therein, a suction hose secured adjacent a bottom wall of said reservoir for connection to said inlet check valve, said stirring blades being perforated blades formed from flat metal sheeting and shaped to stir said solution throughout said reservoir to maintain said solution in said homogeneous state and substantially full of trapped air.

14. A system as claimed in claim 1 wherein said system is secured on a displaceable cart supported on wheels, said pressure control unit being a self-recycling pressure control unit to maintain a substantially constant pressure in a pressure hose connectable to a spray gun.

15. A method of spraying a binder solution having suspended particles which are non-abrasive for coating a product therewith by spraying said product with said solution under pressure, said method comprising the steps of:

i) continuously mixing said binder solution in a reservoir with a stirring impeller having a driven shaft retained in said reservoir to maintain said solution homogeneous, ii) continuously rotatably displacing an abrasive contaminant catcher in said binder solution with said impeller to catch abrasive contaminants, said abrasive contaminant catcher being secured to said driven shaft, iii) drawing a predetermined quantity of said solution from said reservoir through an inlet check valve to fill a chamber of a pump;

iv) pumping said predetermined quantity of said solution under pressure to a pressure control unit of a spraying apparatus through said pump having a reciprocating piston, said step of pumping including:

a) displacing said piston on an upstroke to open said check valve to draw said predetermined quantity of solution therethrough by suction to fill said chamber and simultaneously force under pressure solution in a transfer chamber of said pump to said pressure control unit, b) displacing said piston on a return stroke to apply pressure against said solution in said chamber and thereby forcing said check valve to close and simultaneously operating a transfer check valve of said pump to open to transfer solution from said chamber to said transfer chamber and forcing a portion of said solution to said pressure control unit, and v) creating a washing action of part of said inlet check valve and said pump in contact with said solution by the displacement of said solution under pressure to prevent particles in said solution from striking or settling down in said inlet check valve and said pump.

16. A method as claimed in claim 15 wherein said binder solution is a cold galvanizing airless solution containing powdered zinc.

17. A method as claimed in claim 15 wherein said step (iii) comprises pumping said solution under a pressure of about 1500 lbs.

18. A method as claimed in claim 15 wherein there is further provided the step of adjusting the mixing speed of said solution in said reservoir through a variable speed controller.

19. A method as claimed in claim 18 wherein said pressure control unit automatically controls the pressure of said solution to feed said solution to said spraying apparatus.

20. An airless spray pump system for spraying a binder solution having suspended particles which are non-abrasive for coating a product therewith, said system comprising a reservoir for containment of a supply of said binder solution, mixing means in said reservoir for maintaining said solution in a homogeneous state, a stirring impeller having a driven shaft retained in said reservoir, a variable speed drive and a speed control to adjust the speed of rotation of said driven shaft, stirring blades secured to said driven shaft, and an abrasive contaminant catcher rotatably displaced with said driven shaft, an inlet check valve connected to said reservoir; a pump connected to an outlet port of said inlet check valve for operating said inlet check valve to an open position during an upstroke of a piston of said pump to draw a volume of said solution through said inlet check valve and into a chamber of said pump and simultaneously forcing, under high pressure, solution contained in a transfer chamber of said pump out of said pump to a pressure control unit of a spray apparatus; said piston when displaced on a return stroke applying pressure against said solution in said chamber and forcing said inlet check valve to close under said pressure preventing said solution to flow back to said reservoir and simultaneously operating a transfer check valve of said pump to open to transfer solution from said chamber to said transfer chamber and forcing a portion of said solution under high pressure to said pressure control unit, said solution when displaced through said inlet check valve and said transfer check valve causing a washing action of parts in contact with said solution to thereby prevent particles in said solution from sticking or settling down on said parts in said inlet check valve and said pump.

21. A system as claimed in claim 20 wherein said reservoir is a cylindrical reservoir having a top cover with a filler trap door to receive said solution therein, a suction hose secured adjacent a bottom wall of said reservoir for connection to said inlet check valve, said stirring blades being perforated blades formed from flat metal sheeting and shaped to stir said solution throughout said reservoir to maintain said solution in said homogeneous state and substantially full of trapped air.

* * * * *